United States Patent [19]

Meng

[11] Patent Number: 4,834,611

[45] Date of Patent: May 30, 1989

[54] VORTEX PROOF SHROUDED INDUCER

[75] Inventor: Sen Y. Meng, Reseda, Calif.

[73] Assignee: Rockwell International Corporation, El Segundo, Calif.

[21] Appl. No.: 624,424

[22] Filed: Jun. 25, 1984

[51] Int. Cl.[4] ..... F04D 13/12; F04D 29/68

[52] U.S. Cl. ..... 415/58.5; 415/DIG. 1; 415/914; 415/143

[58] Field of Search ..... 415/53 R, 11, 143, DIG. 1, 415/115, 168; 417/83

[56] References Cited

U.S. PATENT DOCUMENTS

| | | | |
|---|---|---|---|
| 2,984,189 | 5/1961 | Jekat | 415/143 X |
| 3,221,661 | 12/1965 | Swearingen | 415/143 UX |
| 4,150,916 | 4/1979 | Tsutsui et al. | 415/143 |
| 4,375,937 | 3/1983 | Cooper | 415/143 X |
| 4,375,938 | 3/1983 | Dussourd | 415/53 R |
| 4,449,888 | 5/1984 | Balje | 415/143 |

FOREIGN PATENT DOCUMENTS

| | | | |
|---|---|---|---|
| 585315 | 12/1977 | U.S.S.R. | 415/143 |
| 623005 | 7/1978 | U.S.S.R. | 415/53 R |

*Primary Examiner*—Robert E. Garrett
*Assistant Examiner*—Joseph M. Pitko
*Attorney, Agent, or Firm*—H. Fredrick Hamann; Harry B. Field; Clark E. DeLarvin

[57] ABSTRACT

The present invention provides a vortex-free shrouded inducer assembly comprising a forwardly extended shroud (24) and surfaces (36,38) defining a recess proximate to the forward lip (42) of the shroud for favorably diffusing and mixing the flow (54) tending to recirculate about the outer periphery (30) of the inducer prior to its being discharged through nozzle (40).

3 Claims, 3 Drawing Sheets

VORTEX PROOF SHROUDED INDUCER

BACKGROUND OF THE INVENTION

1. Field of Invention

The present invention relates to centrifugal pumps and more particularly, to shrouded inducers for centrifugal pumps having means for avoiding cavitation damage from the recirculation of flow about the shroud.

2. Discussion of the Prior Art

It has been found that the addition of a shroud to an otherwise shroudless inducer arrests the formation of vortices at or about the tips of the inducer blades and thusly avoids the cavitation damage to the inducer associated with such vortices. However, the addition of a shroud creates problems of its own in that a portion of the fluid downstream of the inducer tends to recirculate about the outer periphery of the shroud to re-enter the main flow just upstream of the inducer blades. As the recirculating fluid emerges from behind the forward lip of the shroud it often sheds vortices which impinge directly upon the more radially outward portions of the inducer blades. These shroud vortices thusly create an erosive action upon the afflicted portions of the blades and will cause the inducer to suffer similar losses in efficiency and structural integrity as with the aforementioned tip vortices. In this way, the impetus for providing a shroud to avoid the problems associated with tip vortices is compromised by the problems associated with vortices shed at the forward lip of the shroud.

In attempting to meet this problem, the prior art has provided shrouded inducers with labyrinth seals which are implaced about the outer periphery of the inducer shrouds to minimize the flow being recirculated over the shroud. However, no matter how good the labyrinth seal, there is always some amount of flow which passes under the seal to then cause the aforementioned problems. Moreover, as time goes by labyrinth seals tend to lose their sealing effectiveness, especially in pumps where vibration and thermodynamics subject the seal to any degree of rubbing. Of course, an extensive use of labyrinth seals might be employed to reduce the recirculated flow to an absolute minimum, such as is done in the device of U.S. Pat. No. 2,984,189, but such extensive use is impractical and costly. Thusly, there has remained great interest in the discovery of a means of constructing a shrouded inducer which is not subject to the aforementioned problems associated with vorticles emanating from the shroud.

OBJECTS OF INVENTION

Accordingly, it is an object of the present invention to provide a shrouded impeller which avoids cavitation damage from fluid being recirculated about the shroud.

It is yet another object of the present invention to provide a shrouded inducer which does not require an extensive use of labyrinth seals.

Yet another object of the present invention is to provide an inducer which suffers no cognizable degree of cavitation damage either from tip vortices or from vortices shed by fluid being recirculated about the outer periphery of the inducer.

Still another object of the present invention is to provide a shrouded inducer which does not suffer cavitation damage from any fluid which might be recirculated about the outer periphery of the shroud.

SUMMARY OF INVENTION

All these and other objects are achieved by the present invention which provides a vortex proof shrouded inducer rotatably mounted within a pump housing, wherein the shroud of the inducer is extended sufficiently forward of the leading edges of the inducer blades to allow for the dissipation of any vortices shed by fluid emerging from behind the forward lip of the shroud. For purposes of minimizing the severity and quantity of vortices shed from the shroud, the present invention also provides an annular recess in the pump housing which is partially closed by the forwardly extending portion of the inducer shroud, which recess includes surfaces defining a diffuser for promoting mixing within the recirculating fluid and dissipating at least some of its tangential velocity components. Other surfaces of the recess define a turn-around for the recirculating fluid and yet others in conjunction with the forward lip of the shroud define a nozzle for favorably directing the flow back into the main flow of the pump.

Other objects, advantages and novel features of the present invention will become apparent from the following detailed description of the invention when considered in conjunction with the accompanying drawing.

BRIEF DESCRIPTION OF THE DRAWINGS

The same elements or parts throughout the figures of the drawing are designated by the same reference characters, while equivalent elements bear a prime designation.

DETAILED DESCRIPTION OF THE PREFERRED EMBODIMENTS

Figure 1:
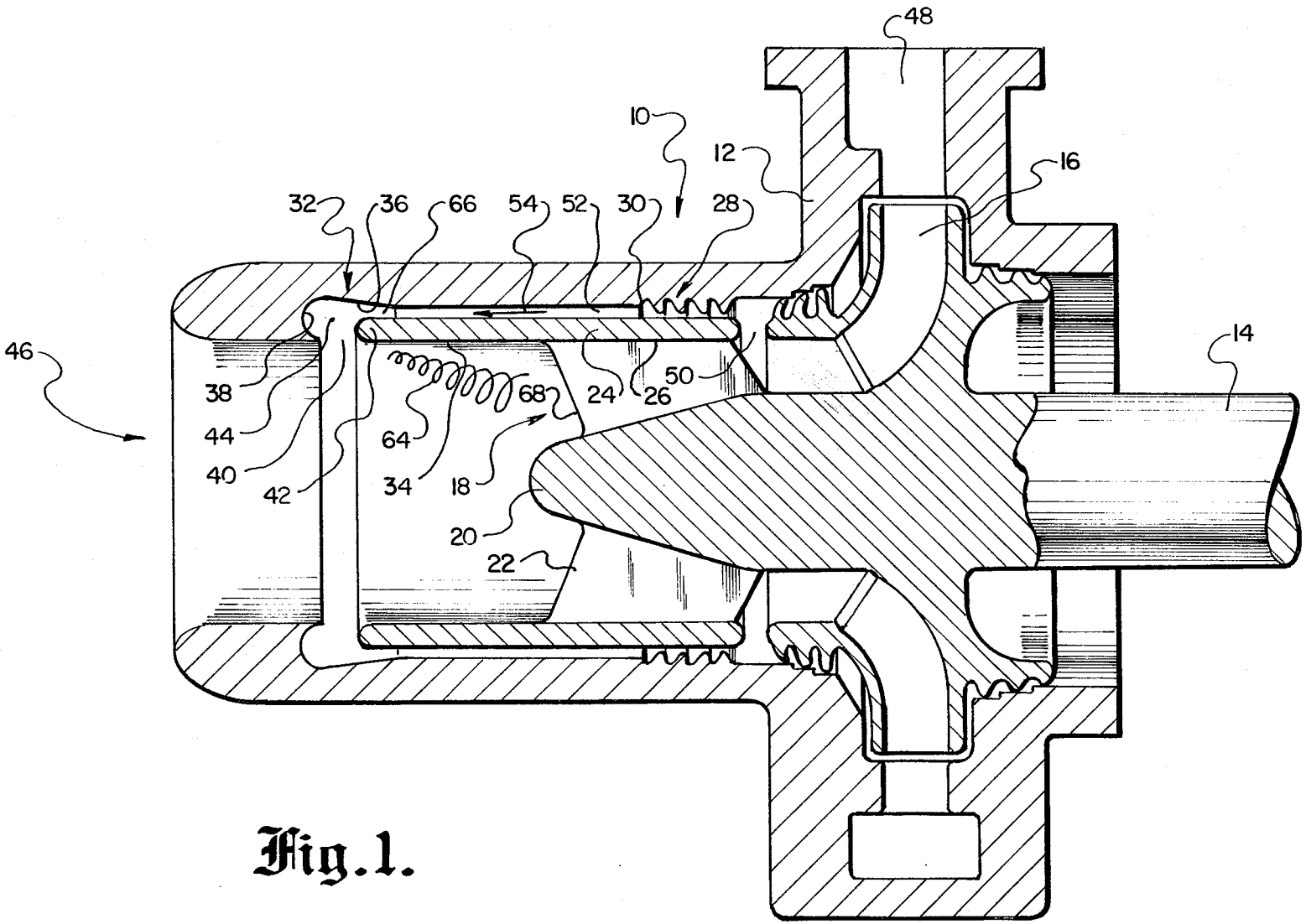
FIG. 1 is a schematic, cross-sectional side view of centrifugal pump having a shrouded inducer constructed according to the preferred embodiment of the present invention.

Referring to FIG. 1, the preferred embodiment of the present invention includes a centrifugal pump 10 comprising a housing 12, a drive shaft 14, rotatably supported by bearings (not shown), an impeller 16 affixed to shaft 14 for imparting a rise in pressure to fluid passing therethrough and a vortex proof shrouded inducer 18 for favorably increasing the pressure of incoming fluid before it enters impeller 16. Vortex proof shrouded inducer 18 itself comprises a hub 20 integrally formed with or otherwise connected to drive shaft 14, inducer blades 22 and a forwardly extending shroud 24 integrally connected to and supported by tips 26 of blades 22. Labyrinth seal 28 forms a flow minimizng seal about the outer periphery 30 of shroud 24. Annular recess 32 in pump housing 12 is partially closed by the forwardly extending portion 34 of inducer shroud 24 and surfaces 36 of recess 32 form a diffuser while surfaces 38 form a flow turn-around. At designation 40, surfaces 38 of annular recess 32 and the forward lip 42 of shroud 24 form a nozzle for favorably directing recirculating flow back into the main flow of pump 10. Annular recess 32 also includes a mixing region 44.

Figure 2:
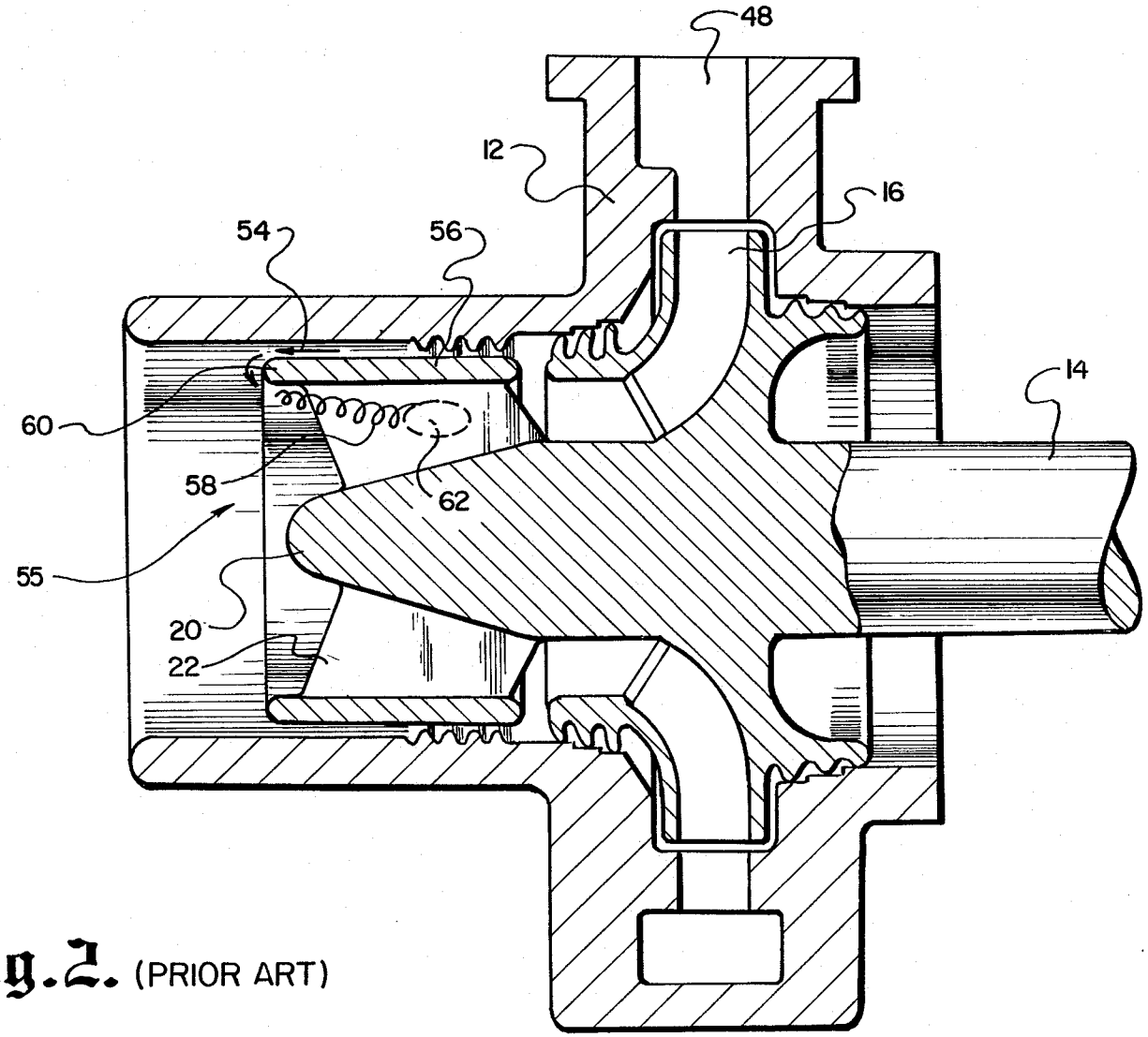
Fig. 2. (PRIOR ART)
FIG. 2 is a schematic, cross-sectional side view of a centrifugal pump constructed according to the prior art.

In operation, torque is supplied through shaft 14 from an external power source (not shown) as fluid is introduced at inlet 46 of pump 10. Shrouded inducer 18 imparts to the incoming fluid a pressure rise and swirl pattern favorable to the pumping operation of impeller 16, which further works the fluid and discharges some into outlet volute 48. However, a portion of the fluid which passes through inducer 18, especially that portion at or about location 50 just downstream of shrouded inducer 18, tends to enter the annular space 52 defined between the outer periphery of shroud 30 and the adjacent portion of pump housing 12. Because this fluid is at a higher pressure than the incoming fluid at inlet 46, and because of the pumping action induced by motion of outer periphery 30 of shroud 24 relative to the adjacent portion of pump housing 12, the fluid in annular space 52 tends to flow in the general direction indicated by the arrow designated 54. This flow is what is herein referred to as a recirculation flow over the shroud, which, in the absence of the present invention, would cause cavitation damage to inducer blades 22 as does occur with prior art inducer 57 as shown in FIG. 2. It is to be understood that although arrow 54 of FIG. 1 and the corresponding arrow 54 of FIG. 2 indicate an axial direction, the recirculation flows also include a substantial tangential component due to the action of the respective shrouds.

Referring to FIG. 2, because the rotation of shroud 56 of the prior art imparts a substantial tangential velocity component to the recirculating flow represented by the arrow designated 54, the recirculating flow tends to shed strong vortices 58 from forward lip 60 of prior art shroud 56. This tendency is further aggravated by the fact that the recirculation flow, when it arrives at lip 60, is in an axial direction which opposes the incoming main flow. Because vortices 58 are strong and originate in close proximity of inducer blades 22, they impinge directly upon region 62 of the blades. As a result, inducer blades 22 of prior art suffer severe cavitation damage at region 62 to the extent that pump efficiency is affected and the structural integrity of blades 22 is often compromised.

Referring back to FIG. 1, the present invention avoids the forementioned problems of the prior art by providing annular recess 32 in housing 12 which serves to minimize the production of vortices off forward lip 42 of shroud 24 and by providing forwardly extended portion 34 of shroud 24 for locating lip 42 sufficiently far upstream of inducer blades 22 such that any vortices 64 which nonetheless form at lip 42 to dissipate before reaching inducer blades 22. As a result, vortex proof inducer 18 advantageously avoids damage from recirculated flows, while employing a shroud to avoid cavitation damage from tip vortices.

Annular recess 32 includes surfaces 36, which, in cooperation with the opposing periphery of inducer shroud 24 form a diffuser 66 for reducing both the axial and tangential velocity components of the recirculating flow. Diffuser 66 empties into mixing region 44 of recess 32 which is bounded by surfaces 38, which surfaces also define a flow turn-around. The recirculating flow, upon entering mixing region 44, is further diffused and allowed to mix to thereby further reduce the tangential velocity components in the flow. The subject flow is then directed by surface 38 to be discharged through nozzle 44 at an acute angle with respect to inner surface of shroud 24 such that at least some of the axial velocity component of the recirculating flow is recovered. Despite the favorable action induced by recess 32, at least some vortices 64 might tend to form, but vortices 64 are far weaker than vortices 58 formed about lip 60 of prior art shrouded inducer 55, the reduction in strength being due to the aforementioned features of recess 32. Because the strength of vortices 64 are so reduced in strength and because vortices 64 originate a distance upstream of inducer blades 22, vortices 64 dissipate upstream from leading edge 68 of inducer blades 22 and thusly are not allowed to cause cavitation damage to inducer 18.

In practicing the present invention, it is preferred that shroud 24 be provided with a forwardly extended section 34 which extends beyond leading edge 68 of blades 22 by an amount in the range of at least one-half ($\frac{1}{2}$) of the inducer diameter to twice (2) the inducer diameter. The longer inducer shroud is much preferred. Annular recess 32 should be constructed such that sufficient diffusion is effected in the recirculating flows to inhibit the production of vortices off forward lip 42 of shroud 24. Recess 32 should also be recessed into housing body 12 away from forward lip 42 such that mixing region 44 is defined sufficiently away from the lip 42 that the rotational movement of the latter does not inhibit the dissipation of the tangential velocity components of the fluid passing through mixing region 44.

It is to be noted that the present invention is advantageous in that it does not require vanes or similar supportive structure in or about space 64 or in annular recess 32 which would otherwise be exposed to the cavitating effects of the flow therethrough.

Figure 3:
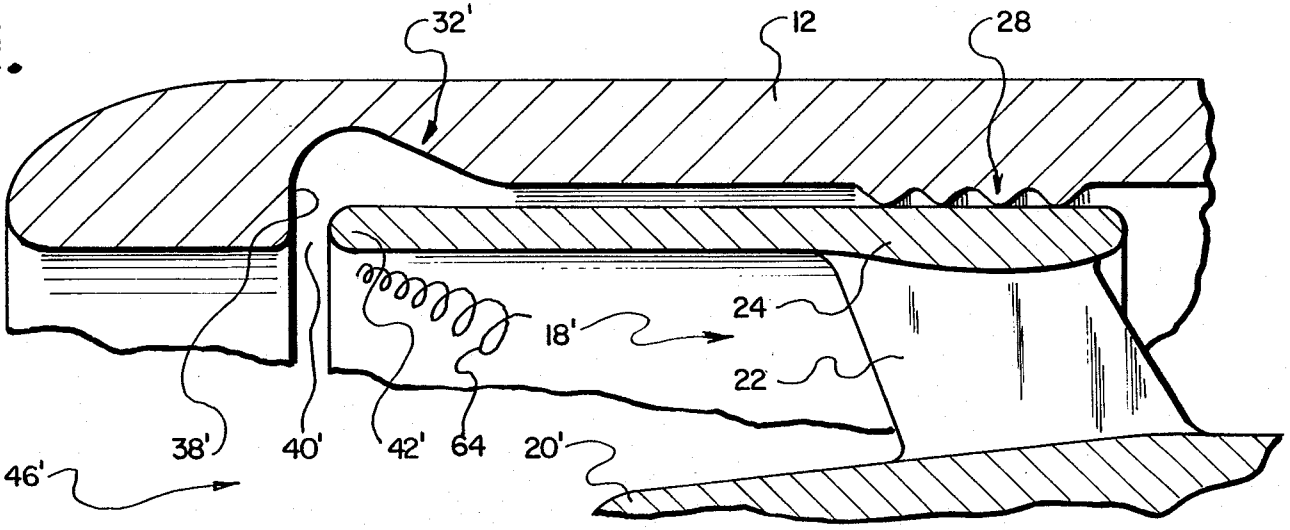
FIG. 3 is a cross-sectional side view of an alternate embodiment of a vortex proof inducer constructed in accordance with the present invention.

Referring to FIG. 3, an alternate embodiment of vortex proof inducer 18' is shown wherein surfaces 38' of recess 32' causes the recirculating flow to be discharged through nozzle 40' in an almost radial direction, which effect increases the radial penetration of the recirculating flow into the incoming main flow. This alternate embodiment provides the advantage that any vortices 64 shed from lip 42' dissipate in a substantially radial direction, so that forwardly extended section 34' of shroud 24 can be made shorter than the forwardly extended section 34 of the preferred embodiment.

Figure 4:
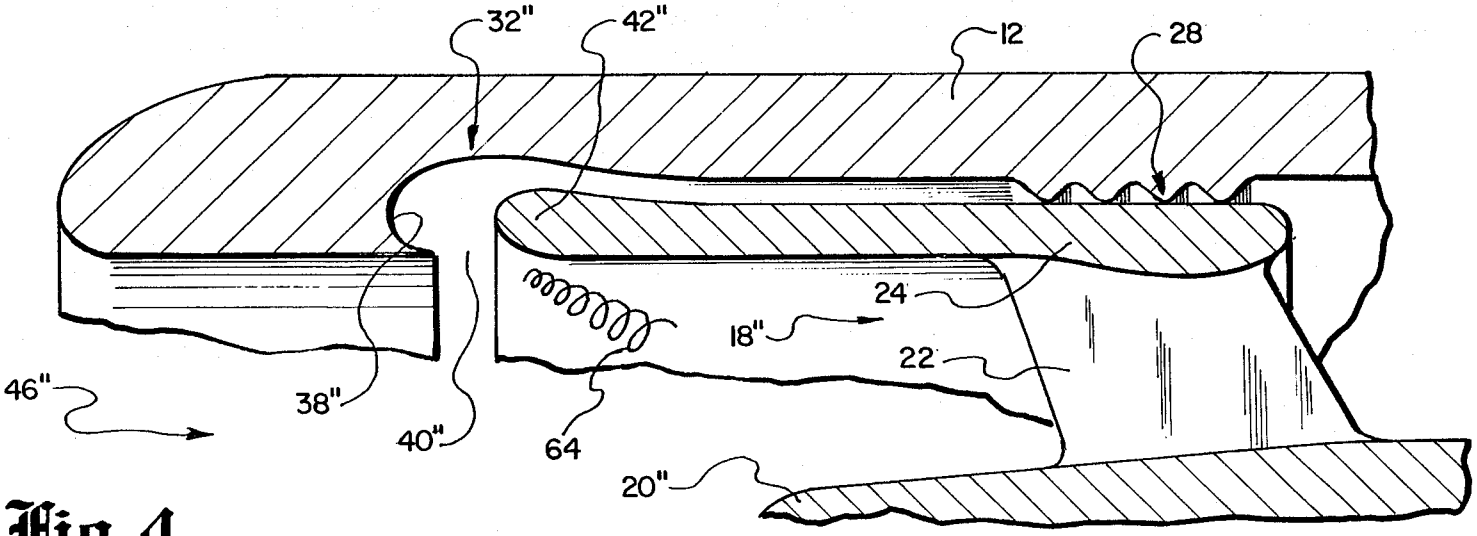
FIG. 4 is a cross-sectional side view of another alternate embodiment of a vortex proof inducer constructed in accordance with the present invention.

In FIG. 4, there is shown another embodiment of vortex proof inducer 18'' having a forward lip 42'' which protrudes radially outwardly and partially into recess 32'' to thereby improve efficiency in the recovery of the axial velocity component of the recirculating flow such that the strengths of vortices 64 are further reduced.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. In a pump having a shrouded inducer including at least one spiral blade circumferentially surrounded by a shroud, said inducer being rotatably mounted within a housing, said housing having a fluid inlet and a fluid outlet, and wherein an annular space defined by an outer periphery of said shroud and an adjacent surface of said housing conveys a recirculation flow over said shroud during operation of said pump, an improvement for alleviation cavitation damage associated with said recirculation flow, said improvement comprising: a section of said shroud extending beyond said blade toward said fluid inlet said section terminating in a lip, the outer periphery of said shroud adjacent said lip and the surface of the housing adjacent said lip defining an annular diffusion zone and an annular mixing zone in said housing for sequentially receiving said recirculation flow from said space, said mixing zone terminating in a nozzle means formed by said lip and an adjacent portion of the surface of said housing for reintroducing said recirculation flow into said inducer with an axial velocity component wherein said shroud includes a labyrinth seal located about the outer periphery of said shroud adjacent an end opposite said diffusion and mixing zone wherein said shroud extends beyond said blade toward said inlet a distance approximately one-half to twice the diameter of said shroud wherein said pump further includes an impeller and wherein said inducer and impeller are affixed to a common shaft for receiving rotation forces therefrom wherein said mixing zone has a cross-sectional flow area greater than said diffusion zone and said diffusion zone has a cross-sectional flow area greater than said annular space.

2. The pump of claim 1 wherein said shroud extends beyond said blade toward said fluid inlet a distance equal to approximately one-half to twice the diameter of said inducer shroud.

3. The pump of claim 1 wherein said nozzle means has a minimum cross-sectional flow area less than said mixing zone.

* * * * *